US012601561B2

(12) United States Patent
Guzeldere

(10) Patent No.: US 12,601,561 B2
(45) Date of Patent: Apr. 14, 2026

(54) RECOIL DAMPING SYSTEM FOR HIGH PRESSURE GAS FIREARMS

(71) Applicant: Mehmet Ali Guzeldere, Antalya (AR)

(72) Inventor: Mehmet Ali Guzeldere, Antalya (AR)

( * ) Notice: Subject to any disclaimer, the term of this patent is extended or adjusted under 35 U.S.C. 154(b) by 0 days.

(21) Appl. No.: 18/869,292

(22) PCT Filed: Jul. 21, 2022

(86) PCT No.: PCT/TR2022/050776

§ 371 (c)(1),
(2) Date: Nov. 26, 2024

(87) PCT Pub. No.: WO2023/249579

PCT Pub. Date: Dec. 28, 2023

(65) Prior Publication Data

US 2025/0305793 A1 Oct. 2, 2025

(30) Foreign Application Priority Data

Jul. 21, 2022 (TR) ..... 2022/010268

(51) Int. Cl.
*F41C 23/08* (2006.01)
*F41C 23/20* (2006.01)

(52) U.S. Cl.
CPC ..... *F41C 23/08* (2013.01); *F41C 23/20* (2013.01)

(58) Field of Classification Search
CPC ..... F41C 23/08; F41C 23/20; F41C 23/06; F41C 23/14
See application file for complete search history.

(56) References Cited

U.S. PATENT DOCUMENTS 247,451 A * 9/1881 White ..... F41C 23/06 42/74
480,587 A * 8/1892 Jones et al. ..... F41C 23/06 42/74
490,129 A * 1/1893 Tredway et al. ..... F41C 23/08 42/74
524,458 A * 8/1894 Blake ..... F41C 23/08 42/74
935,163 A * 9/1909 Parker ..... F41C 23/06 42/74

(Continued)

FOREIGN PATENT DOCUMENTS

GB 189408892 A * 3/1895
WO 2020176016 A1 9/2020

*Primary Examiner* — Joshua E Freeman
(74) *Attorney, Agent, or Firm* — Bayramoglu Law Offices LLC

(57) ABSTRACT

A recoil damping system includes at least one easily attached and detached spring tube of variable stiffness, absorbing the severe recoil created in firearms firing heavy-weight cartridges with high gas pressure. In the system in question, the spring tubes absorb the severe recoil that is created in firearms firing heavy-weight cartridges with high gas pressure in contrast to the known technique, and hence the impact on the shooter's shoulder is minimized. Thus, after the shot, the pain and injuries suffered by the shooter due to severe recoil are not in question any longer. The practical recoil damping system is compatible with all firearms firing heavy-weight cartridges with high gas pressure, where easily attached and detached spring tubes with variable stiffness can be applied.

3 Claims, 4 Drawing Sheets

(56) References Cited

U.S. PATENT DOCUMENTS 935,822 A * 10/1909 Schmidt ..... F41C 23/06 42/74
1,042,132 A * 10/1912 Long ..... F41C 23/08 42/74
1,147,941 A * 7/1915 Haslett ..... F41C 23/06 42/74
1,246,117 A * 11/1917 Krueger ..... F41C 23/08 42/74
1,255,566 A * 2/1918 Pearson ..... F41C 23/06 42/74
1,307,529 A * 6/1919 Werndl ..... F41C 23/06 42/74
1,328,700 A * 1/1920 Wagoner ..... F16F 15/067 42/74
1,964,649 A * 6/1934 Stetson ..... F41C 23/06 42/74
2,455,438 A * 12/1948 Oppold ..... F41C 23/06 42/74
2,754,608 A * 7/1956 Stieffel, Jr. ..... F41C 23/06 42/74
3,019,543 A * 2/1962 Ducharme ..... F41C 23/06 42/74
3,707,797 A * 1/1973 Ruth ..... F41C 23/06 42/74
3,754,344 A * 8/1973 Spiliotis ..... F41C 23/06 42/74
5,375,360 A * 12/1994 Vatterott ..... F41C 23/08 42/74
10,663,252 B1 * 5/2020 Sprainis ..... F41C 23/08
2001/0011434 A1 * 8/2001 Gussalli Beretta ..... F41C 23/08 42/74
2004/0144011 A1 * 7/2004 Vignaroli ..... F41C 23/08 42/74
2006/0096148 A1 * 5/2006 Beretta ..... F41C 23/06 42/74
2006/0254112 A1 * 11/2006 Snoderly ..... F41C 23/06 42/74
2009/0178323 A1 * 7/2009 Fluhr ..... F41C 23/20 42/71.01
2013/0145668 A1 * 6/2013 Valin ..... F41C 23/08 42/74
2018/0335272 A1 * 11/2018 Heinz ..... F41C 23/20
2018/0356183 A1 * 12/2018 Romer ..... F41C 23/08
2019/0390936 A1 * 12/2019 Keng ..... F41C 23/22

* cited by examiner

RECOIL DAMPING SYSTEM FOR HIGH PRESSURE GAS FIREARMS

CROSS REFERENCE TO THE RELATED APPLICATIONS

This application is the national phase entry of International Application No. PCT/TR2022/050776, filed on Jul. 21, 2022, which is based upon and claims priority to Turkish Patent Application No. 2022/010268, filed on Jun. 21, 2022, the entire contents of which are incorporated herein by reference.

TECHNICAL FIELD

The invention relates to a recoil damping system for firearms with high gas pressure and heavy cartridge/bullet weight.

BACKGROUND

Recoil system in firearms; generally defined as an operating system in which the energy to operate the various mechanisms of the firearm and automate the loading of another cartridge is derived from the inertia of the spent shell casing.

When the gun is fired, the bullet is pushed in one direction by the gunpowder explosion; in return, the rifle is pushed back and recoil is created. The factors affecting the recoil can be listed as follows;

Weight of the rifle.

The weight of the cartridge and the powder charge

Barrel diameter

Muzzle velocity.

Recoil decreases as the weight of the rifle increases, while recoil increases as other factors increase. Physically it is possible to calculate the recoil via a formula. Recoil decreases as the weight of the rifle increases, while recoil increases as other factors increase. Physically it is possible to calculate the recoil via a formula. In this formula, the recoil energy is calculated by dividing the square of the sum of the product of the cartridge weight and the muzzle velocity of the cartridge, and the product of the powder charge and 4700, with the product of the weight of the gun and 64.4. Values here should be taken in pounds.

There is a difference between the measured and felt (perceived) recoil. Physics formulates the action of the weapon and what the result is. However, since the recoil perceived by the shooter is also related to the mental and physical condition of the shooter, the felt recoil force varies from person to person. The main factors here can be listed as follows;

Suitability of the weapon to the shooter

Shooter's experience

The shooter's mental and physical condition at that moment

Type of weapon (pump-riffle, semi-automatic=gas or kinetic energy)

Recoil-reducing supports or apparatus.

The thickness of the shooter's suit

The intensity of the sound of the gun, startle response.

Suggestions made to the shooter about the recoil of the gun

As we explained above, it is clear that recoil as a physical force is related to the barrel diameter and the cartridge used. Pads are used in today's rifles to reduce the load on the shooter's shoulder caused by the recoil force. Although the pad absorbs some of the incoming force during recoil, it cannot be successful in rifles with high gas pressure and heavy cartridge weight. For this reason, this type of weapon is preferred by physically strong shooters.

It has been reported by shooters that an additional 33 percent more recoil of the 89 MM cartridge is painful when several shots are fired with both 76 MM and 89 MM cartridges, with a 3-kilo 400-gram rifle containing the pad used to prevent the current recoil. It was also reported that the shooters agreed that the 89 MM cartridge made the rifle more difficult to handle. Almost all shooters complain of the pain and recovery time of heavy recoil after shooting.

SUMMARY

The invention relates to a recoil damping system, which includes at least one spring tube with variable stiffness, which can be easily attached and detached, absorbing the severe recoil in firearms with high gas pressure and heavy weight cartridges/bullets. In the system in question, the impact on the shooter's shoulder is minimized by the spring tubes absorbing the severe recoil that occurs in firearms with high gas pressure and heavy-weight cartridges/bullets at the maximum level, in contrast to the known technique. Thus, after the shot, the pain and injuries caused by the severe recoil are not in question any longer. The invention is a practical recoil damping system that is compatible with all firearms, can be easily attached and detached, and can be applied with spring tubes of variable stiffness.

THE MEANING OF THE NUMBERS SHOWN IN THE FIGURES

Figure 1:
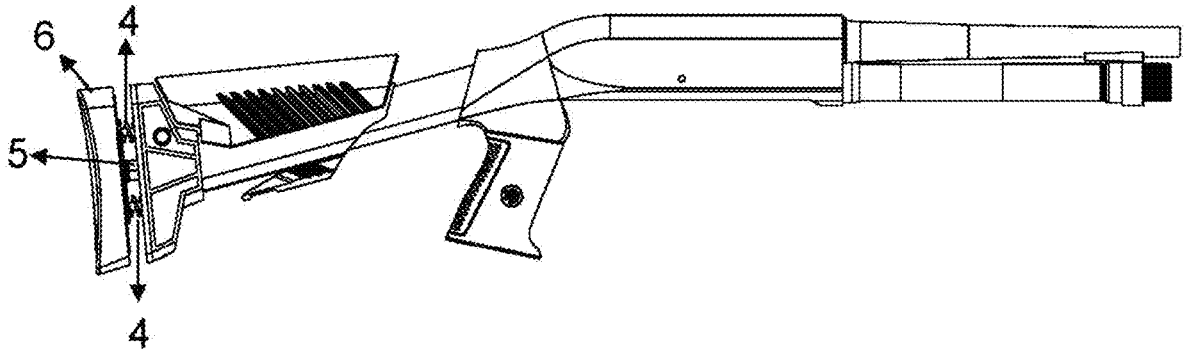
FIG. 1. View of the Recoil Damping System Assembled on a Firearm
Figure 2:
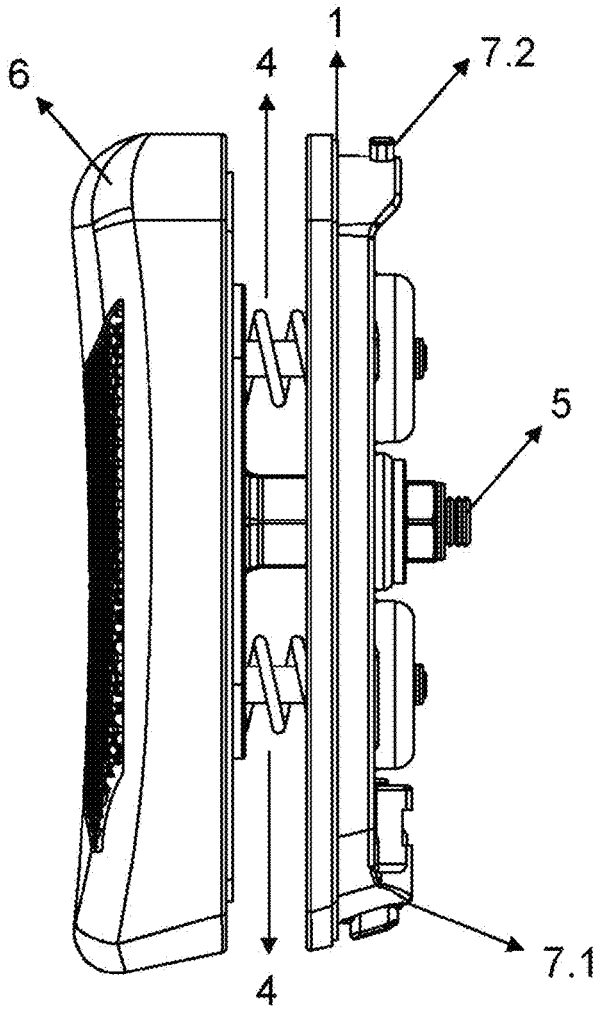
FIG. 2. Detailed View of the Recoil Damping System on a Firearm
Figure 3:
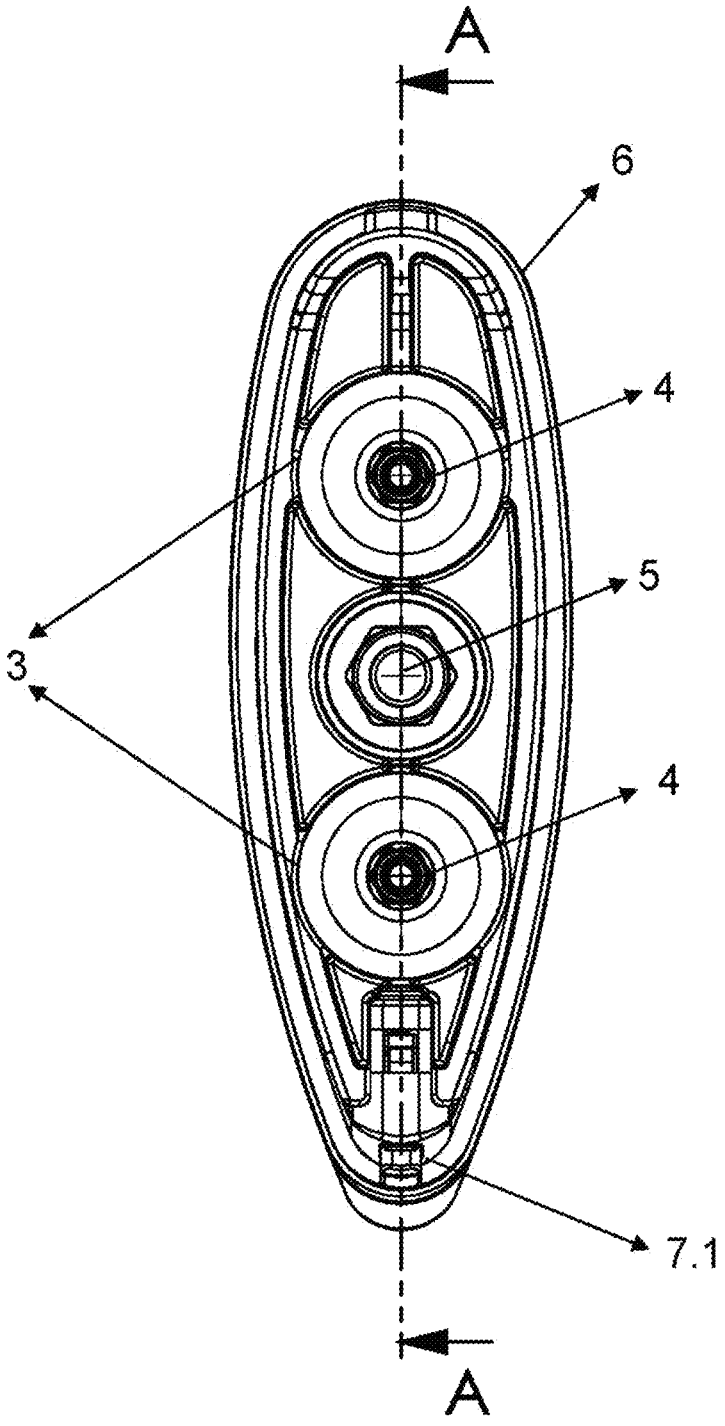
FIG. 3. Back View of the Recoil Damping System
Figure 4:
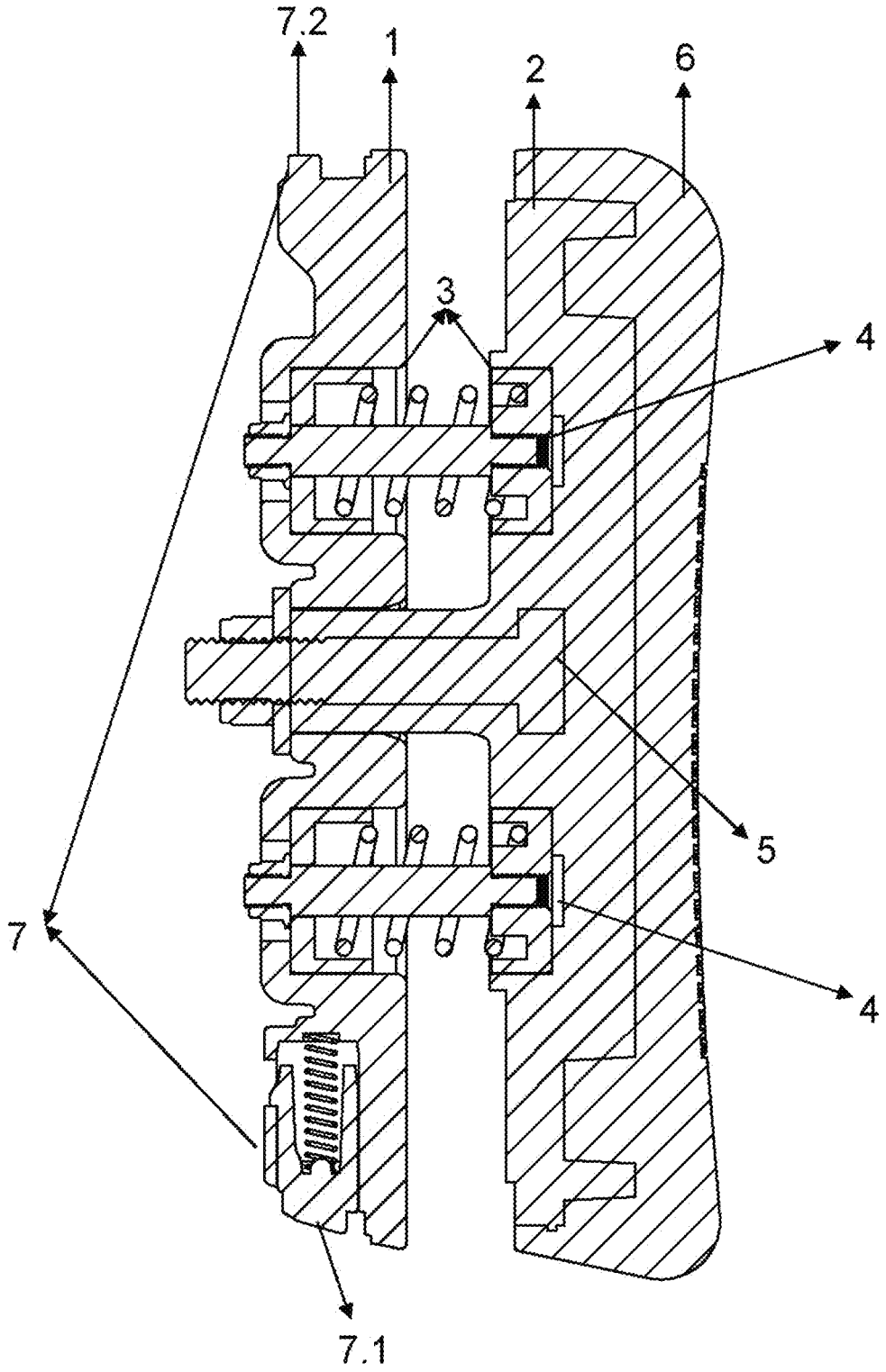
FIG. 4. A-A Sectional View
Figure 5:
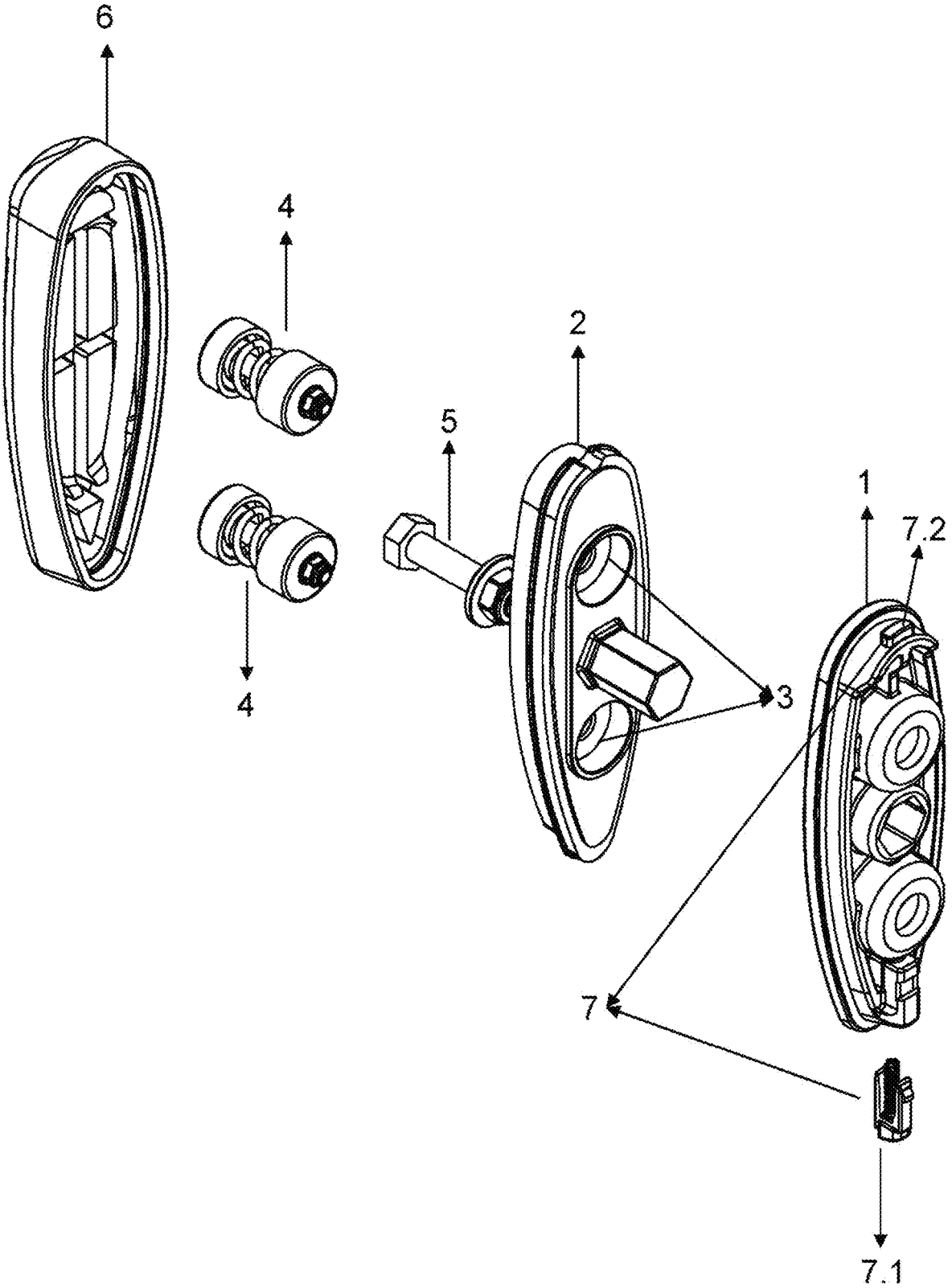
FIG. 5. Exploded View of the Recoil Damping System

1. Inner Body
2. Outer Body
3. Spring Tube Channel
4. Spring Tube
5. Connecting Cam
6. Pad
7. Lock system
  7.1. Locking Latch
  7.2. Lock Slot

DETAILED DESCRIPTION OF THE EMBODIMENTS

The invention consists of inner body (1), outer body (2), spring tube channel (3), spring tube (4), connecting cam (5), pad (6) and lock system (7) parts. The lock system (7) includes the locking latch (7.1) and the lock slot (7.2).

The recoil damping system, which is the subject of the invention, is characterized by the spring tubes (4) placed in at least one spring tube channel (3) located on the inner body (1) and outer body (2) on both sides of the connecting cam (5) in a manner that there is a distance between an inner body (1) and an outer body (2) so that inner body (1) can move back and forth on the connecting cam (5) of the outer body (2). There is a pad (6) on the outer body (2) for the shooter to place the rifle on his shoulder and to have a comfortable grip. There is a lock system (7) located on the inner body (1), which allows the assembled set to be easily attached and dismounted from the butt of the rifle. The recoil damping assembly set, which is placed in the lock slot (7.2) on the butt, is locked to the butt with the help of the lock latch (7.1), and thus becomes ready for operation.

The invention, which is suitable for firearms with high gas pressure and heavy-weight cartridges/bullets, is used by selecting the appropriate stiffness from the spring tubes (4) and placing them in the spring tube channel (3) according to the barrel diameter of the firearm used, the type of cartridge and the powder charge. After the shooter fires, the recoil force that is created while the firearm mechanism moves rearwards by the inertia created when the buckshot is pushed forward in the barrel as a result of rifle firing the gunpowder comes to the inner body (1), which forms the contact surface with the rifle butt. The inner body (1) transmits the recoil force to the spring tubes (4), which are placed in the spring tube channels (3), selected with the stiffness suitable for the barrel diameter, type of cartridge, and the powder charge. While the recoil force is damped in the spring tubes (4), the inner body (1) moves on the connecting cam (5) as much as the compression ratio in the spring tubes (4). Thus, most of the recoil force generated is damped and the remaining part is transferred to the outer body (2), and the shooter completes his shot without suffering pain and without injury with the help of the pad (6) on his shoulder.

Our invention provides comfort to the shooter by minimizing the injury and the shoulder pain suffered as a result of recoil, which is the biggest obstacle to the preference of firearms with high gas pressure and heavy-weight cartridges/bullets by the shooters. In addition, this type of firearm gives the shooters, whose physical strength is not sufficient, the opportunity to experience this pleasure.

The fact that the invention can be applied to a firearm with high gas pressure and heavy-weight cartridges/bullets, and that it can be easily assembled and disassembled, and that the spring tubes (4) can be easily changed according to the recoil hardness and the user's preferences during the shooting in the hunting area and for sports purposes, are among the most important factors that facilitate its use.

What is claimed is:

1. A recoil dampening system for firearms with high gas pressure and heavy-weight cartridges/bullets, comprising:

an inner body forming a contact surface with a rifle butt, an outer body containing a pad and a spring tube channel, wherein the spring tube channel forms a bearing for spring tubes, wherein the spring tubes are connected to the inner body with a connecting cam, at least one spring tube channel on the inner body and the outer body, wherein the at least one spring tube channel forms the bearing for the spring tubes, wherein at least one spring tube comprises a tubular housing enclosing an internal compression spring, at least one spring tube, wherein the at least one spring tube provides damping by transmitting a recoil force, wherein the inner body is subjected to the recoil force, the connecting cam, wherein the connecting cam allows the inner body to move towards the outer body at a compression ratio of the spring tubes when the inner body is subjected to the recoil force, and a locking system, wherein the locking system enables a recoil damping assembly set, wherein the recoil damping assembly set is formed by the spring tubes placed in the at least one spring tube channel on the inner body and the outer body on both sides of the connecting cam, to be connected to the rifle butt in a manner to have a distance between the inner body and the outer body so that the inner body is allowed to move back and forth on the connecting cam.

2. The recoil dampening system according to claim 1, wherein a stiffness of the spring tube is selected according to a barrel diameter, a type of a cartridge, and a powder charge, and the spring tube is used by attaching at least one of the spring tubes in the at least one spring tube channels on the inner body and the outer body.

3. The recoil dampening system according to claim 1, wherein the locking system comprises a lock slot and a lock latch, wherein the lock latch enables the recoil damping assembly set to be mounted and attached and detached easily on the rifle butt.

* * * * *